US009528785B2

(12) United States Patent
Klett et al.

(10) Patent No.: US 9,528,785 B2
(45) Date of Patent: Dec. 27, 2016

(54) COOLING OF WEAPONS WITH GRAPHITE FOAM

(75) Inventors: James W. Klett, Knoxville, TN (US); Michael P. Trammell, Jacksboro, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 13/700,147

(22) PCT Filed: Dec. 7, 2010

(86) PCT No.: PCT/US2010/059168

§ 371 (c)(1),
(2), (4) Date: Nov. 27, 2012

(87) PCT Pub. No.: WO2012/011934

PCT Pub. Date: Jan. 26, 2012

(65) Prior Publication Data

US 2013/0061503 A1 Mar. 14, 2013

Related U.S. Application Data

(60) Provisional application No. 61/400,217, filed on Jul. 23, 2010.

(51) Int. Cl.

| | |
|---|---|
| ***F41A 13/00*** | (2006.01) |
| ***F41A 13/12*** | (2006.01) |
| ***F41A 21/44*** | (2006.01) |

(52) U.S. Cl.

CPC ..... *F41A 13/12* (2013.01); *F41A 21/44* (2013.01)

(58) Field of Classification Search

CPC ..... F41A 13/12
USPC ..... 89/14.1
See application file for complete search history.

(56) References Cited

U.S. PATENT DOCUMENTS

| | | | | |
|---|---|---|---|---|
| 2,112,144 | A * | 3/1938 | Coupland | 89/14.1 |
| 2,935,912 | A | 5/1960 | Hartley | |
| 2,967,368 | A | 1/1961 | Williams | |
| 4,638,713 | A | 1/1987 | Milne et al. | |
| 4,753,154 | A | 6/1988 | Higashi | |
| 4,841,836 | A | 6/1989 | Bundy | |
| 4,982,648 | A | 1/1991 | Bol et al. | |
| 5,062,346 | A | 11/1991 | Greve Hansen et al. | |
| 5,400,691 | A | 3/1995 | Suttie et al. | |
| 5,469,649 | A | 11/1995 | Rowlands et al. | |
| 6,033,506 | A | 3/2000 | Klett | |

(Continued)

FOREIGN PATENT DOCUMENTS

| | | | |
|---|---|---|---|
| DE | EP0033770 | 8/1981 | |
| GB | DE4400512 | 7/1994 | |
| LU | GB 191415462 A * | 5/1915 | F41A 21/24 |

OTHER PUBLICATIONS

Klett, James W., "Fact Sheet: Signature and Heat Managment: Highly Conductive Graphite Foam,".
International Search Report, PCT/US2010/059168, 2010.

*Primary Examiner* — Gabriel Klein
(74) *Attorney, Agent, or Firm* — Colin L. Cini

(57) ABSTRACT

Disclosed are examples of an apparatus for cooling a barrel 12 of a firearm 10 and examples of a cooled barrel assembly 32 for installation into an existing firearm 10. When assembled with the barrel 12, a contact surface 16 of a shell 14 is proximate to, and in thermal communication with, the outer surface of the barrel 18. The shell 14 is formed of commercially available or modified graphite foam.

13 Claims, 17 Drawing Sheets

(56) References Cited

U.S. PATENT DOCUMENTS

| | | | | |
|---|---|---|---|---|
| 6,037,032 | A | 3/2000 | Klett et al. | |
| 6,261,485 | B1 | 7/2001 | Klett | |
| 6,287,375 | B1 | 9/2001 | Klett | |
| 6,298,764 | B1 | 10/2001 | Sherman et al. | |
| 6,314,857 | B1 | 11/2001 | Schmidt et al. | |
| 6,344,159 | B1 | 2/2002 | Klett | |
| 6,387,343 | B1 | 5/2002 | Klett | |
| 6,398,994 | B1 | 6/2002 | Klett | |
| 6,399,149 | B1 | 6/2002 | Klett et al. | |
| 6,491,891 | B1 | 12/2002 | Klett et al. | |
| 6,508,159 | B1 * | 1/2003 | Muirhead | 89/14.1 |
| 6,656,443 | B2 | 12/2003 | Klett | |
| 6,673,328 | B1 | 1/2004 | Klett et al. | |
| 6,780,505 | B1 | 8/2004 | Klett et al. | |
| 6,855,744 | B2 | 2/2005 | Klett et al. | |
| 6,889,464 | B2 * | 5/2005 | Degerness | 42/76.02 |
| 7,070,755 | B2 | 7/2006 | Klett et al. | |
| 7,213,498 | B1 * | 5/2007 | Davies | 89/198 |
| 7,456,131 | B2 | 11/2008 | Klett et al. | |
| 7,670,682 | B2 | 3/2010 | Klett et al. | |
| 7,707,763 | B2 | 5/2010 | Brixius | |
| 7,963,203 | B1 * | 6/2011 | Davies | 89/14.1 |
| 8,196,701 | B1 * | 6/2012 | Oliver | 181/223 |
| 2003/0034575 | A1 * | 2/2003 | Hardcastle et al. | 264/29.7 |
| 2004/0119629 | A1 | 6/2004 | Hinsverk | |
| 2006/0207152 | A1 | 9/2006 | Lazor | |
| 2007/0039224 | A1 | 2/2007 | Skinner | |
| 2008/0275150 | A1 * | 11/2008 | Miller et al. | 521/80 |
| 2011/0173864 | A1 * | 7/2011 | Christensen et al. | 42/78 |

* cited by examiner

| | Density | Thermal Conductivity | Compressive Strength | Compressive Modulus | Tensile Strength |
|---|---|---|---|---|---|
| Foam Grade | [g/cm3] | [W/mK] | [ksi] | [ksi] | [ksi] |
| Koppers | | | | | |
| K-Foam® L1 | 0.38 | 70 | 0.49 | 44.9 | 1.15 |
| K-Foam® D1 | 0.48 | 110 | 0.36 | 58.0 | 0.98 |
| K-Foam® L1 w/phenolic | 0.69 | 50 | 0.73 | 44.3 | 0.428 |
| K-Foam® L1 1000psi | 0.67 | 116 | 0.94 | 63.3 | — |
| K-Foam® L1 1000psi w/phenolic | 0.93 | 105 | 2.70 | 116.0 | — |
| Poco Graphite | | | | | |
| Pocofoam® | 0.63 | 117 | 0.36 | 32 | — |
| Poco HTC® | 0.9 | 245 | 0.85 | — | — |
| Poco foam® w/phenolic | 0.8 | 82 | 0.73 | 27 | — |

FIG. 1

COOLING OF WEAPONS WITH GRAPHITE FOAM

CROSS-REFERENCE TO RELATED APPLICATIONS

This application claims the benefit of U.S. Provisional Patent Application Ser. No. 61/400,217, entitled "COOLING OF WEAPONS WITH GRAPHITE FOAM", filed Jul. 23, 2010, which is herein incorporated by reference in its entirety.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in the invention.

THE NAMES OF THE PARTIES TO A JOINT RESEARCH AGREEMENT

None.

BACKGROUND OF THE INVENTION

1. Field of the Invention

The present disclosure relates to the improved performance of weapons and more specifically to increasing the cooling of firearm barrels.

2. Description of the Related Art

Firearms are used to discharge a projectile, such as a bullet, at a target. Firearms include rifles, shotguns, pistols, and revolvers with integral or removable barrels. A cartridge or round is first loaded, manually or automatically, into a proximal chamber at the breech end of the barrel; then, a firing pin strikes a primer in the base of the casing, igniting an explosive charge of expanding gases that propel the bullet out of the top of the casing. The bullet then travels within a central, longitudinal bore in the barrel and exits a distal muzzle end. A series of helical lands and grooves in the bore wall introduce a twist about the bullet's central axis, vastly improving its accuracy. The lands and grooves are known as rifling.

The expanding and combusting gases within the barrel's bore generate heat energy, which, in turn, raises the temperature of the surrounding barrel material. In most cases, barrels are made of high strength, carbon steel to withstand the high pressures. Firing many rounds in rapid succession can raise the temperature of some barrels to over 600 degrees Celsius (1100 degrees Fahrenheit). Heat radiating from the top of the barrel can interfere with the down range view of a target through the sights. A large temperature gradient can also occur along a barrel's longitudinal length, causing the barrel to deflect slightly, thus negatively affecting the firearm's accuracy. Excessive heat can also lead to a phenomenon known as cook-off. This occurs when the chamber of the barrel becomes so hot that, when a round is inserted into the chamber and the firing is ceased, the primer auto-ignites, causing a bullet to discharge from the muzzle without the trigger ever being pulled.

In some instances, barrels must be allowed to cool for a period of time or a cool replacement barrel must be interchanged before continued firing can continue. In other instances, the rate of fire must be rationed to ensure that the barrel doesn't overheat. Neither of these situations is ideal when a soldier is facing an enemy insurgent in a hostile firefight.

U.S. Pat. No. 2,935,912; U.S. Pat. No. 4,753,154; and US Patent Application Publication Number 2007/0039224 teach conductive cooling of barrels through contact with a liquid coolant medium such as water. U.S. Pat. No. 4,982,648; U.S. Pat. No. 5,062,346; U.S. Pat. No. 7,707,763; US Patent Application Publication Number 2004/0119629; and US Patent Application Publication Number 2006/0207152 teach convective cooling of barrels by directing a stream of ambient air through grooves, channels, shells, and shrouds disposed about the barrel. U.S. Pat. No. 4,638,713; U.S. Pat. No. 5,400,691; and U.S. Pat. No. 6,298,764 teach wrapping of barrels with insulating materials to reduce their infrared signature, equalize the temperature gradient along the barrel's length, and suppress the muzzle flash.

Despite the various teachings disclosed in the prior art, further enhancements to barrel cooling technology are needed.

BRIEF SUMMARY OF THE INVENTION

Disclosed are examples of an apparatus for passively cooling a barrel of a firearm and examples of a passively cooled barrel assembly for installation into an existing firearm. When assembled with the barrel, a contact surface of a shell is proximate to, and in thermal communication with, an outer surface of the barrel. The shell is formed of commercially available or modified graphite foam.

BRIEF DESCRIPTION OF THE SEVERAL VIEWS OF THE DRAWINGS

A more complete understanding of the preferred embodiments will be more readily understood by reference to the following detailed description when considered in conjunction with the accompanying drawings where like numerals indicate common elements among the various figures.

FIG. 1 is a table comparing several properties of commercial graphite foams to the properties of modified graphite foams.

DETAILED DESCRIPTION OF THE INVENTION

Figure 2A:
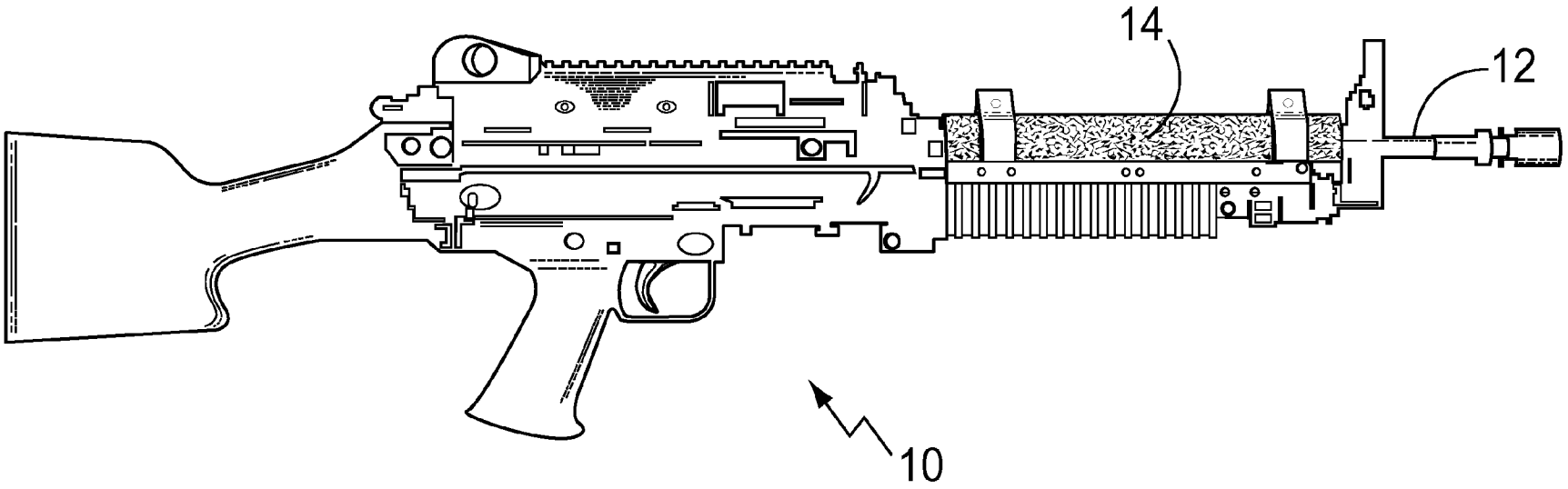
FIG. 2*a* is a side view illustrating an example of a firearm with a graphite foam shell installed on the barrel.
Figure 2B:
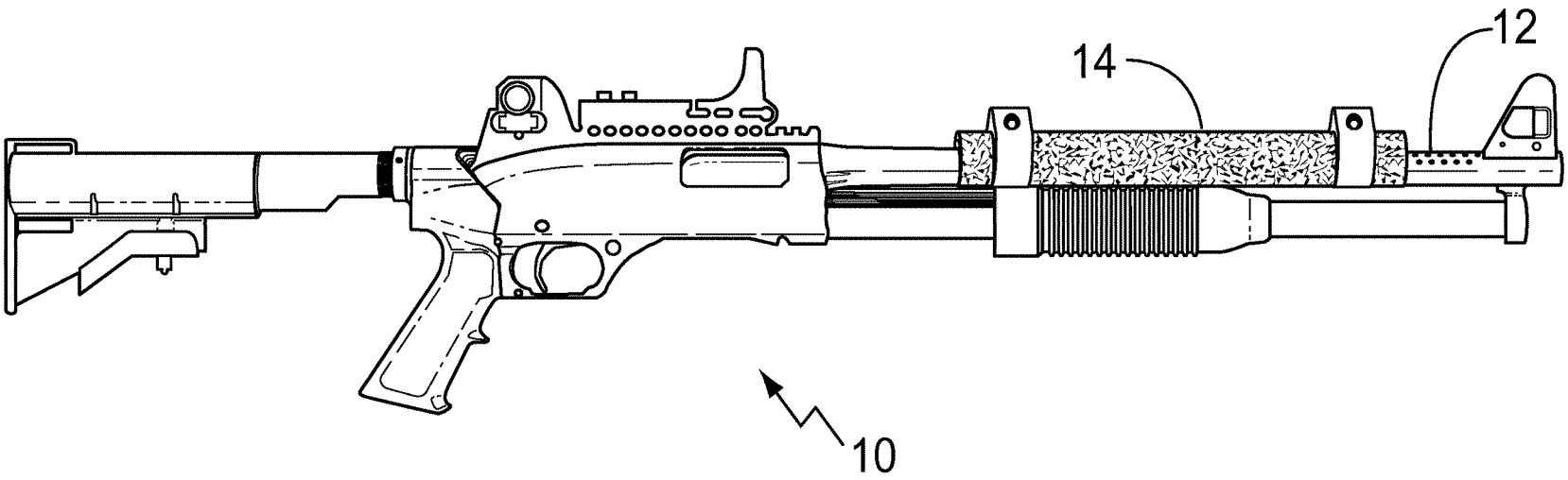
FIG. 2*b* is a side view illustrating another example of a firearm with a graphite foam shell installed on the barrel.
Figure 2C:
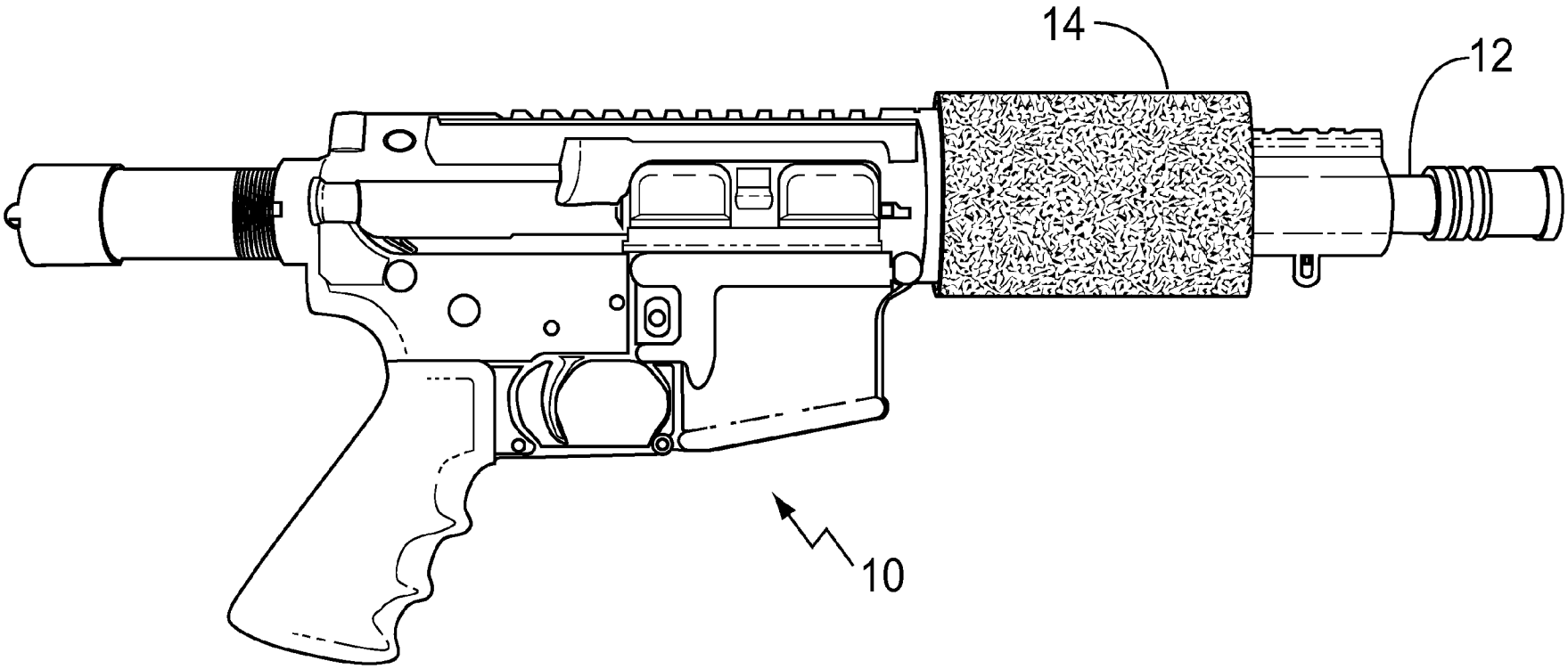
FIG. 2*c* is a side view illustrating yet another example of a firearm with a graphite foam shell installed on the barrel.
Figure 2D:
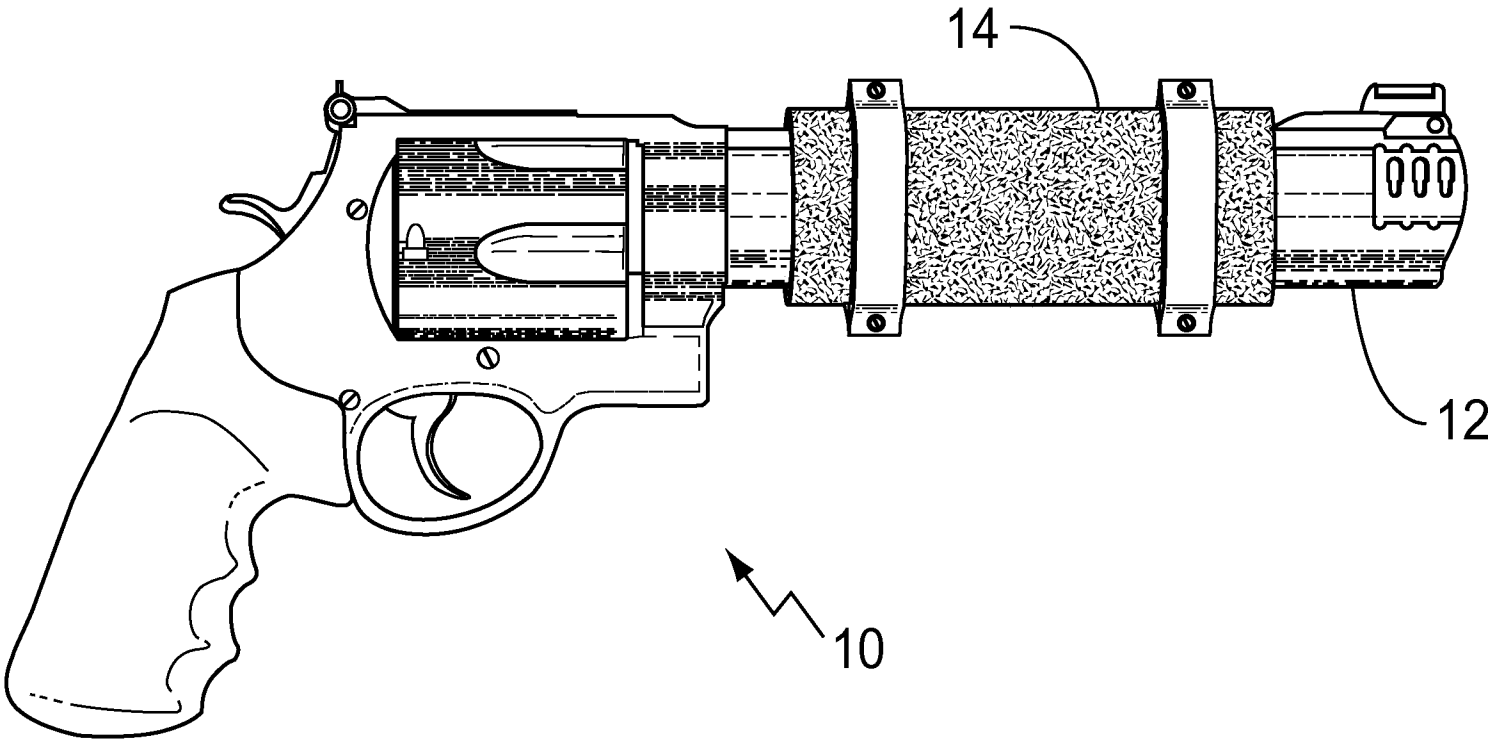
FIG. 2*d* is a side view illustrating yet another example of a firearm with a graphite foam shell installed on the barrel.

The cooling of weapons with graphite foam will now be described in detail with the following enabling disclosure. Graphite foam is a structure with highly ordered graphitic ligaments, is dimensionally stable, has open porosity, and has excellent thermal management capability. Commercial graphite foams are available with a variety of physical properties from Poco Graphite, Inc., 300 Old Greenwood Road, Decatur, Tex. 76234, and Koppers, LLC, 436 Seventh Avenue, Pittsburgh, Pa. 15219-1800. Additionally, graphite foam articles and methods of manufacturing graphite foam articles are described in U.S. Pat. No. 6,033,506 "PROCESS FOR MAKING CARBON FOAM"; U.S. Pat. No. 6,037,032 "PITCH-BASED CARBON FOAM HEAT SINK WITH PHASE CHANGE MATERIAL"; U.S. Pat. No. 6,261,485 "PITCH BASED CARBON FOAM AND COMPOSITES"; U.S. Pat. No. 6,287,375 "PITCH BASED FOAM WITH PARTICULATE"; U.S. Pat. No. 6,344,159 "METHOD FOR EXTRUDING PITCH BASED FOAM"; U.S. Pat. No. 6,387,343 "PITCH-BASED CARBON FOAM AND COMPOSITES"; U.S. Pat. No. 6,398,994 "METHOD OF CASTING PITCH BASED FOAM"; U.S. Pat. No. 6,399,149 "PITCH-BASED CARBON FOAM HEAT SINK WITH PHASE CHANGE MATERIAL"; U.S. Pat. No. 6,491,891 "GELCASTING POLYMERIC PRECURSORS FOR PRODUCING NET-SHAPED GRAPHITES"; U.S. Pat. No. 6,656,443 "PITCH BASED CARBON FOAM AND COMPOSITES"; U.S. Pat. No. 6,673,328 "PITCH BASED CARBON FOAM AND COMPOSITES AND USES THEREOF"; U.S. Pat. No. 6,780,505 "PITCH-BASED CARBON FOAM HEAT SINK WITH PHASE CHANGE MATERIAL"; U.S. Pat. No. 6,855,744 "GELCASTING POLYMERIC PRECURSORS FOR PRODUCING NET-SHAPED GRAPHITES"; U.S. Pat. No. 7,070,755 "PITCH-BASED CARBON FOAM AND COMPOSITES AND USE THEREOF"; U.S. Pat. No. 7,456,131 "INCREASED THERMAL CONDUCTIVITY MONOLITHIC ZEOLITE STRUCTURES"; and U.S. Pat. No. 7,670,682 "METHOD AND APPARATUS FOR PRODUCING A CARBON BASED FOAM ARTICLE HAVING A DESIRED THERMAL-CONDUCTIVITY GRADIENT", which are each herein incorporated by reference as if included at length.

In order to increase the durability of the commercial foams for barrel cooling, the strengths of the commercial foams were modified by the inventors. There were three approaches taken. First, the operating pressures of the foam during the forming stage were modified to increase the number of cells per inch, thus improving the density and strength. Second, by incorporating carbon nanotubes (CNTs) into the foam ligaments prior to foaming, it was hypothesized that the strengths of the ligaments would be increased in a similar way as adding carbon fibers. Third, by filling the foams partially with polymers, it was theorized that the strength and durability could also be increased.

In some graphite foam examples, pitch precursor from Koppers was used to produce graphite foams with a varying production pressure of between 250 psi to 1000 psi, and more specifically, production pressures of 250 psi, 400 psi, 600 psi, and 1000 psi. The higher the production pressure is, the smaller the voids are and the higher the foam density becomes. After foaming, the sample parts were carbonized at 1000 C to produce thermally insulating carbon foam, and then graphitized to 2800 C to convert the carbon foams to graphite foam that is highly thermally conductive.

In other graphite foam examples, multi-walled carbon nanotubes (CNTs), produced at Oak Ridge National Labs, were blended into the pitch using ethanol and a shear homogenizer. The CNTs were blended in ratios between 0.2% and 1.0% by weight, and more specifically, 0.2%, 0.3%, 0.4%, 0.5%, and 1.0% by weight. The blended NCT/pitches were then dried and placed in pans for foaming. The mixed precursor was then foamed with the standard foaming process at different pressures as described above. After foaming, the sample parts were carbonized at 1000 C to produce thermally insulating carbon foam, and then graphitized to 2800 C to convert the carbon foams to graphite foam that is highly thermally conductive.

In yet other graphite foam examples, commercial graphite foams were purchased from Koppers, LLC and Poco Graphite, Inc. (Grade L1 from Koppers and PocoFoam® from Poco). These foams were then filled with phenolic resins in the ratios between 20% and 80% by weight, and more specifically, 20%, 40%, 60% and 80% by weight. After forming the graphite foam, phenolic resin may partially or fully fill the pores of the foam. The phenolic resin may be manually applied on the surface, and/or infused into the foam pores under a vacuum. The densified foams were cured at 300 C to fully cross-link the phenolic resin and prevent degradation during use. In additional examples, a very high temperature capability epoxy resin was used to fully densify the foams. The resin, AREMCO 526N made by Aremco Products, Inc. P.O. Box 517, 707-B Executive Boulevard, Valley Cottage, N.Y. 10989, was chosen as it has high strength and a maximum use temperature of over 300 C.

As shown in the table of FIG. 1, it was found that by increasing the foam pressure to 1000 psi and filling the resulting graphite foams with polymers, the strength, modulus and thermal conductivity are vastly improved over the commercial foams.

Once formed, the graphite foam blocks were machined into shells for assembly with a firearm barrel. The blocks can be machined with a bandsaw, waterjet, electro-discharge, miller, lathe, grinder, drill, or other capable method.

Referring now to FIGS. 2*a*-2*d*, there are illustrated several examples of firearms 10 having barrels 12 that will benefit from a shell 14 formed of graphite foam according to the present disclosure. Shown are an exemplary rifle, an exemplary shotgun, an exemplary pistol, and an exemplary revolver. The examples illustrated are not exhaustive, as many firearm architectures have existed in the past, currently exist today, or will exist in the future. It is to be understood that the shell 14 of the present disclosure will benefit all types of firearm 10 barrels 12 in general.

Figure 3:
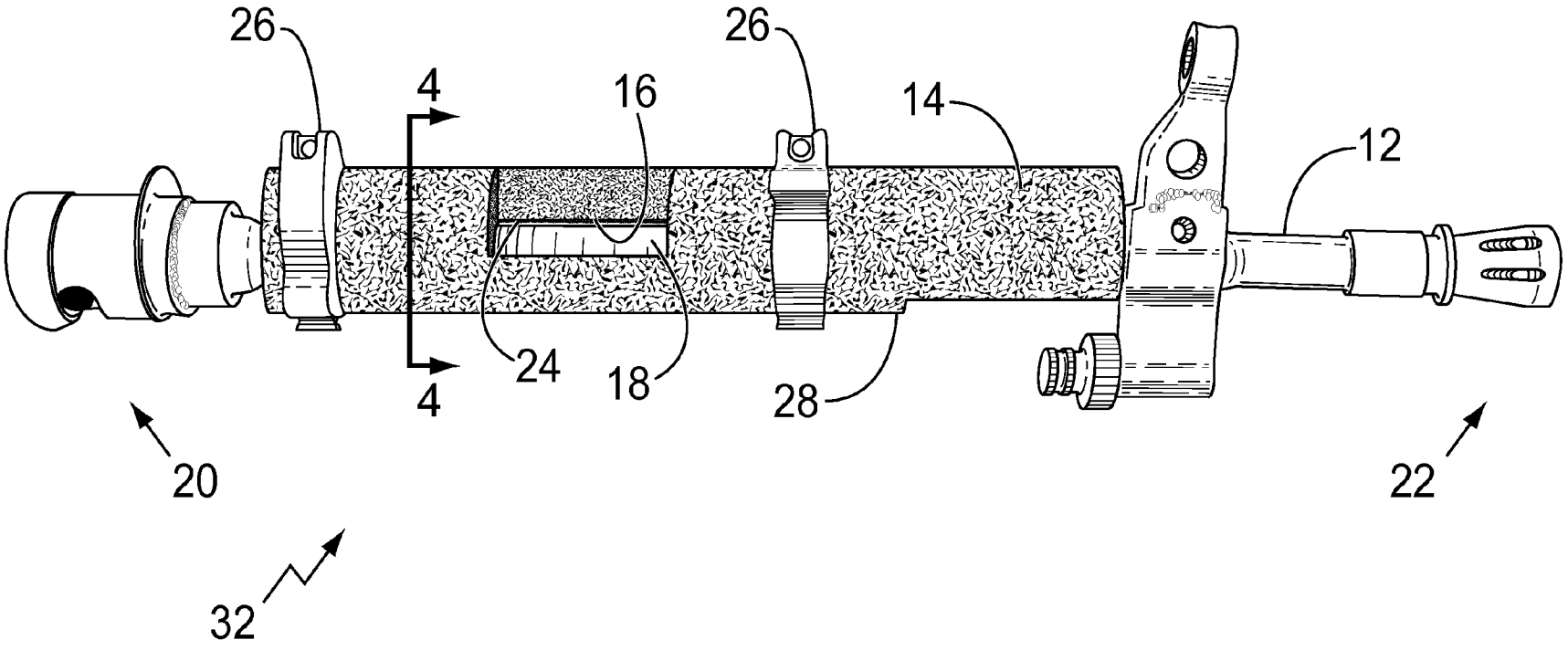
FIG. 3 is a partial, sectional, side view illustrating details of a graphite foam shell assembled with a barrel of a firearm as illustrated in FIG. 2*a*.
Figure 4:
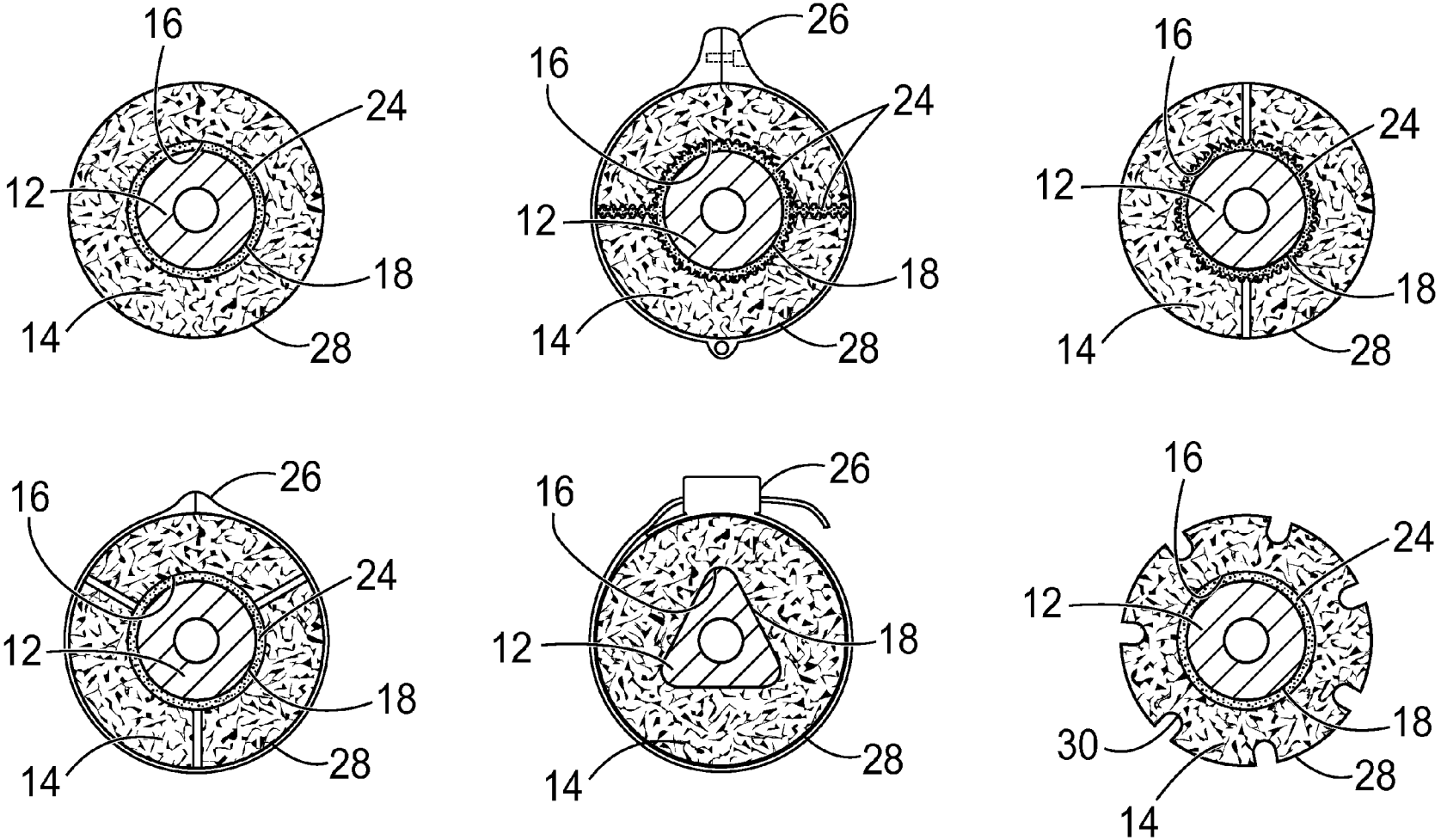
FIG. 4 is a series of cross sectional views illustrating various exemplary shell configurations taken along line 4-4 of FIG. 3.
Figure 5A:
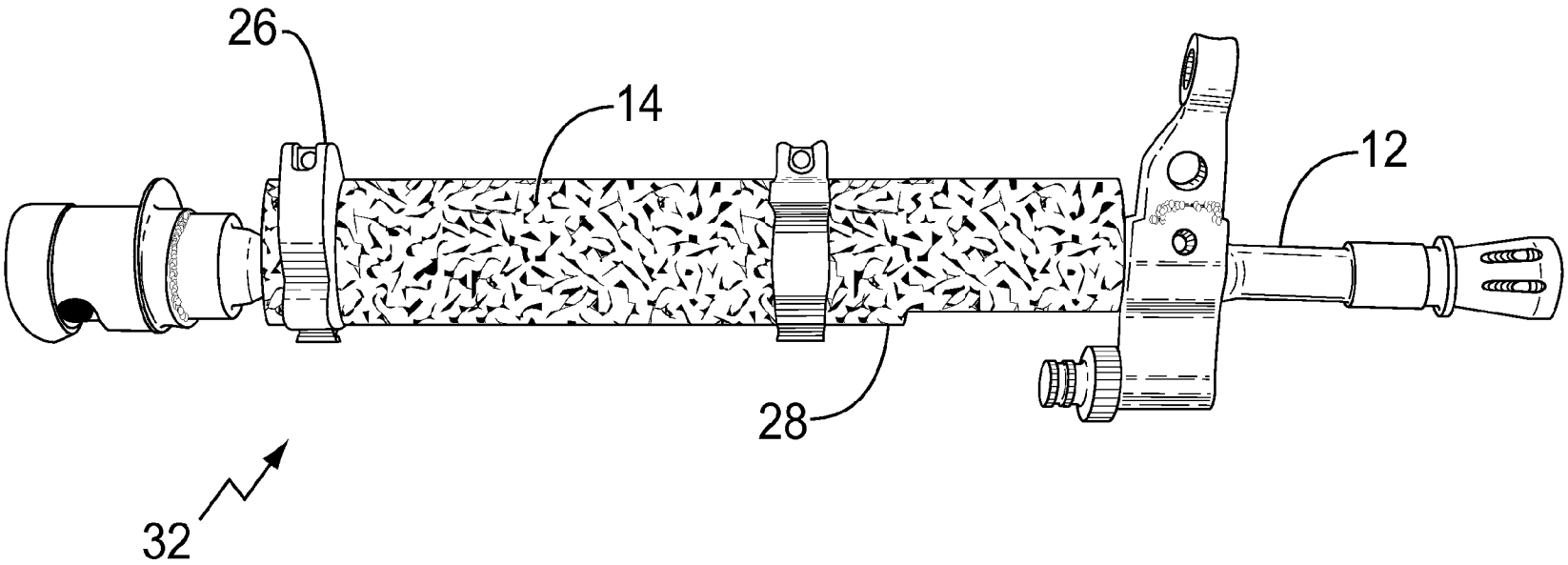
FIG. 5*a* is a side view illustrating an example of the external features of a graphite foam shell assembled with a barrel of a firearm.
Figure 5B:
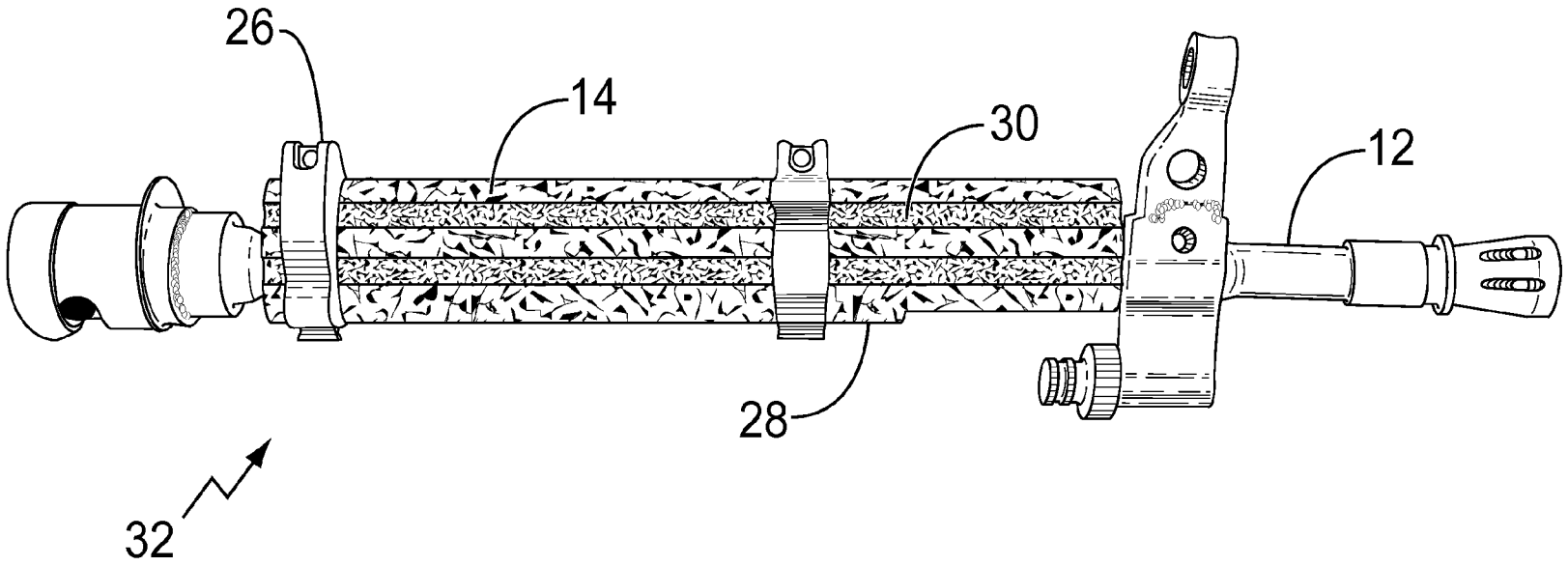
FIG. 5*b* is a side view illustrating another example of the external features of a graphite foam shell assembled with a barrel of a firearm.
Figure 5C:
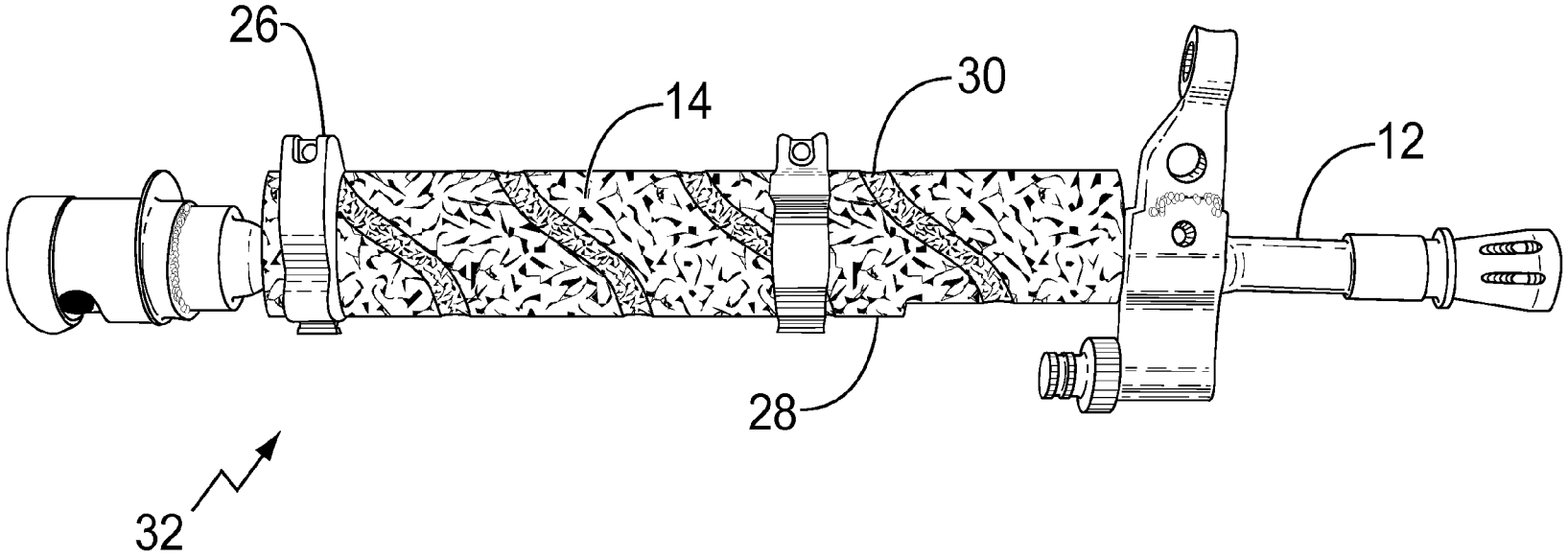
FIG. 5*c* is a side view illustrating yet another example of the external features of a graphite foam shell assembled with a barrel of a firearm.
Figure 5D:
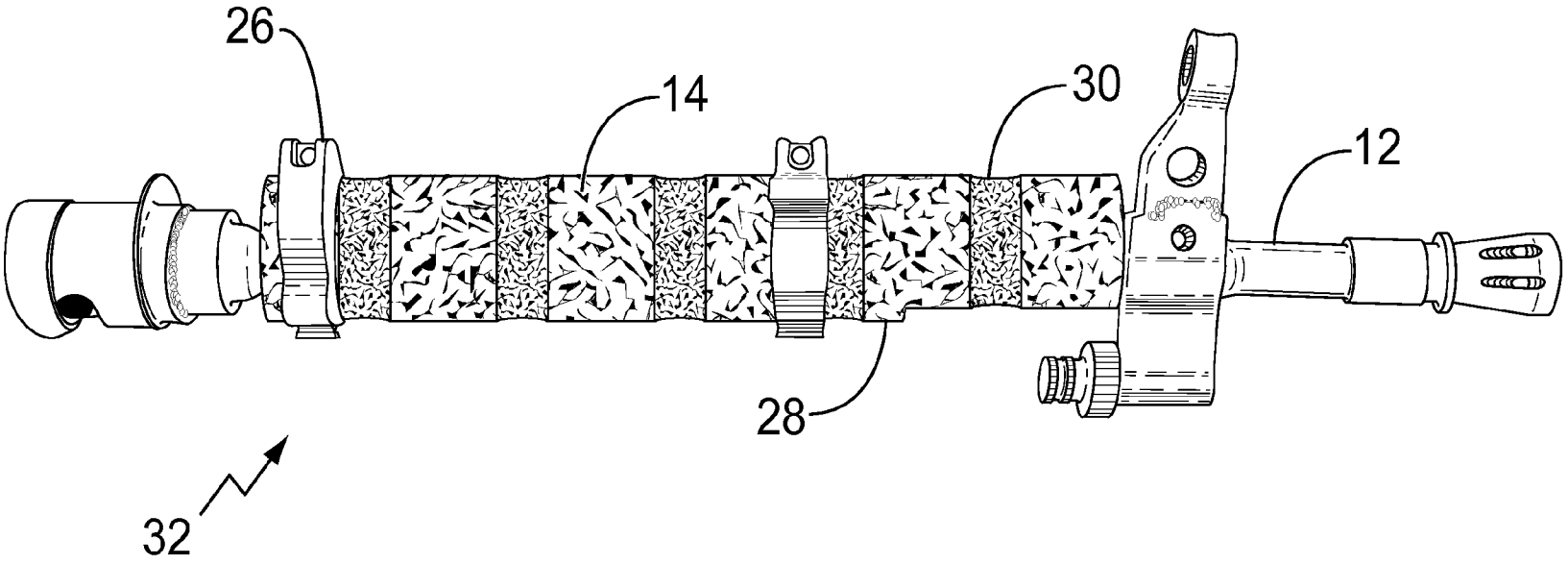
FIG. 5*d* is a side view illustrating yet another example of the external features of a graphite foam shell assembled with a barrel of a firearm.
Figure 5E:
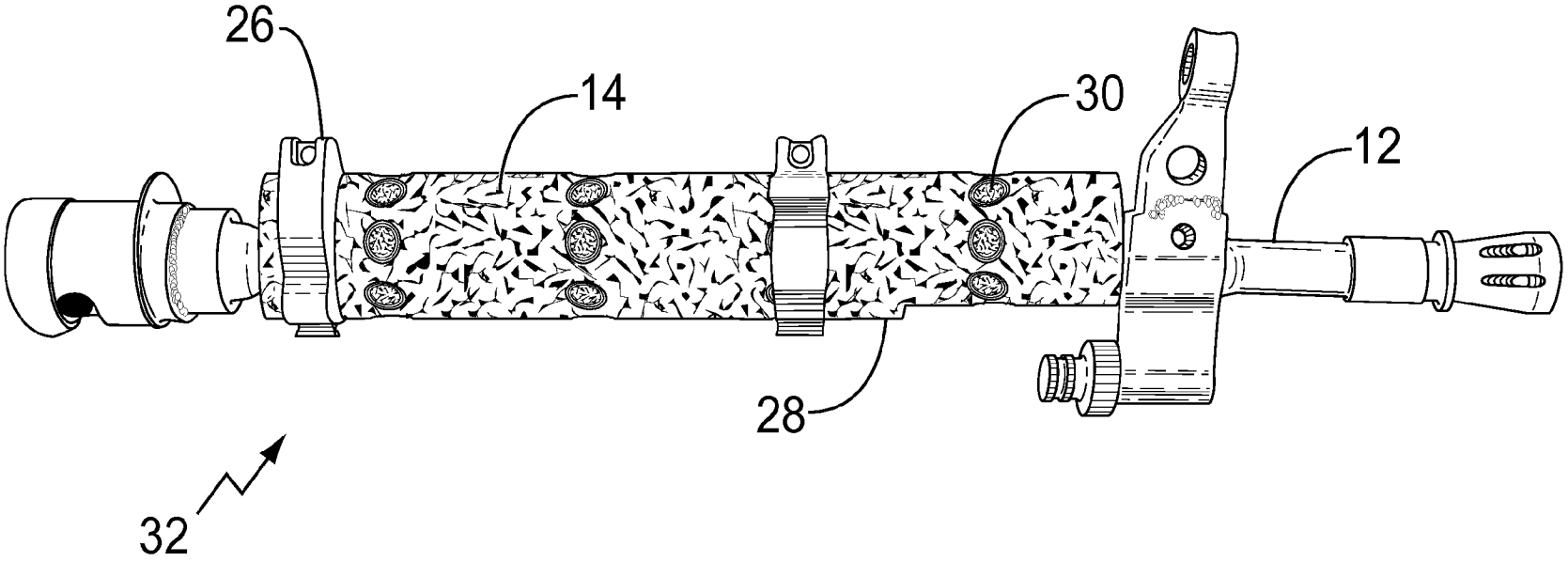
FIG. 5*e* is a side view illustrating yet another example of the external features of a graphite foam shell assembled with a barrel of a firearm.

Referring now to FIGS. 3 and 4, the graphite foam shell 14 has a contact surface 16 that is placed proximate to, and in thermal communication with, an outer surface 18 of a barrel 12 when it is assembled with the barrel 12. Thermal communication means that a transfer of heat occurs from the outer surface 18 of the barrel 12 to the contact surface 16 of the graphite foam shell 14. In other words, heat is removed from the barrel 12 by the shell 14. The shell 14 is disposed longitudinally at least between the breech 20 and muzzle 22 ends of the barrel 12, but some examples may extend beyond the breech 20 and/or the muzzle 22 ends (example not shown). In other examples, the shell 14 may extend around a gas transfer tube or other feature of the firearm 10 that generates excess heat (example not shown). The shell 14 may extend completely around the outer surface 18 of the barrel 12, or it may extend only partially around the outer surface 18 of the barrel 12. The shell 14 may be formed of one single segment (e.g., a tube), or it may be formed of multiple segments split in a longitudinal direction (e.g., clamshells) or split in a circumferential direction (e.g., disks). The contact surface 16 that is proximate to, and in thermal communication with, the outer surface 18 of the barrel 12 may contain features such as undercuts, ribs, flutes, holes, standoffs, pedestals, grooves, etc. . . . to improve the fitment with the barrel 12 and; therefore, increase conductive heat transfer from the outer surface 18 of the barrel 12 to the contact surface 16 of the shell 14.

The graphite foam shell 14 may be attached to the barrel 12 by use of a high thermal conductivity adhesive means 24 (e.g. AREMCO high thermal conductivity adhesive sold by Aremco Products, Inc. P.O. Box 517, 707-B Executive Boulevard, Valley Cottage, N.Y. 10989), or by use of clamping means 26 (e.g., bolts, bands, ring clamps, hose clamps, wire, hook and loop, tape, zip ties, etc. . . . ), or both the adhesive means 24 and the clamping means 26 may be used. The adhesive means 24 may be disposed at the interface between the shell 14 and the barrel 12, or at the interface between separate shell 14 segments or at both interfaces. The clamping means 26 will typically be placed about an external surface 28 of the shell 14 for ease of assembly and disassembly. In other examples, especially with a single segment, tubular shell 14, a slight press fit is all that is used to assemble the shell 14 with the barrel 12.

Referring now to FIGS. 5*a*-5*e*, an external surface 28 of the shell 14 may be featureless (e.g., smooth) or have various features 30 included individually or combined together. Such features 30 include longitudinal flutes, spiral flutes, circumferential flutes and dimples. Additional features 30 (e.g., dovetails, weaver attachments, picatinny attachments, rails, etc. . . . ) known for attaching accessories may also be included (not shown). The features 30 may be machined into the graphite foam shell 14 before or after assembly with a barrel 12. Please note that in some of the illustrated examples, the clamping means 26 are removed for clarity.

In some examples, the shell 14 is manufactured and then assembled to a barrel 12 that is already installed to a firearm 10. This assembly technique is used if the barrel 12 is integral with, or not easily disassembled from, the frame portion of the firearm 10 (e.g., a revolver). In other examples, the shell 14 and barrel 12 are first integrated together into a cooled barrel assembly 32 and then installed with an existing firearm 10. According to this example, the cooled barrel assemblies 32 are manufactured and provided as a spare kit or retrofit kit for existing firearms 10.

While firing rounds of ammunition at a high cyclic rate, heat energy from the expanding gases transfers from the bore into the material of the barrel 12. The heat energy is then transferred to the outer surface of the barrel 18 and is thermally communicated by convection into the contact surface 16 of the shell 14. The heat moves outwardly through the shell 14 body to the shell's external surface 28, where it radiates into the surrounding environment. By reducing a barrel's 12 temperature, improved sight picture, improved accuracy, extended high cyclic rate of fire, reduced rifling wear, and reduced barrel replacement costs will result. The shell 14 is resistant to chemicals, resistant to shock, low cost, and adds only a marginal increase in overall weight of the firearm.

To confirm that a graphite foam shell 14 will cool a barrel 12 during a high cyclic rate of fire, exemplary shells 14 with a smooth external surface 28 and a fluted external surface 28 were fabricated from 1000 psi Koppers K-Foam® and then densified with phenolic to a 40% by weight loading. The fabricated shells 14 were bonded to the barrels of a Mk-46 5.56 mm Lightweight Machine gun, manufactured by FN Herstal USA, using AREMCO high thermal conductivity adhesive 24 (Aremco 568) and ring-clamping means 26. The cooled barrel assemblies 32 were then compared to a conventional, bare barrel using a 200 round 5.56 mm cartridge belt and a continuous cyclic rate of fire. Thermocouples were affixed to the barrel 12 and cooled barrel assemblies 32 to record the transient temperatures during and after firing.

Figure 6:
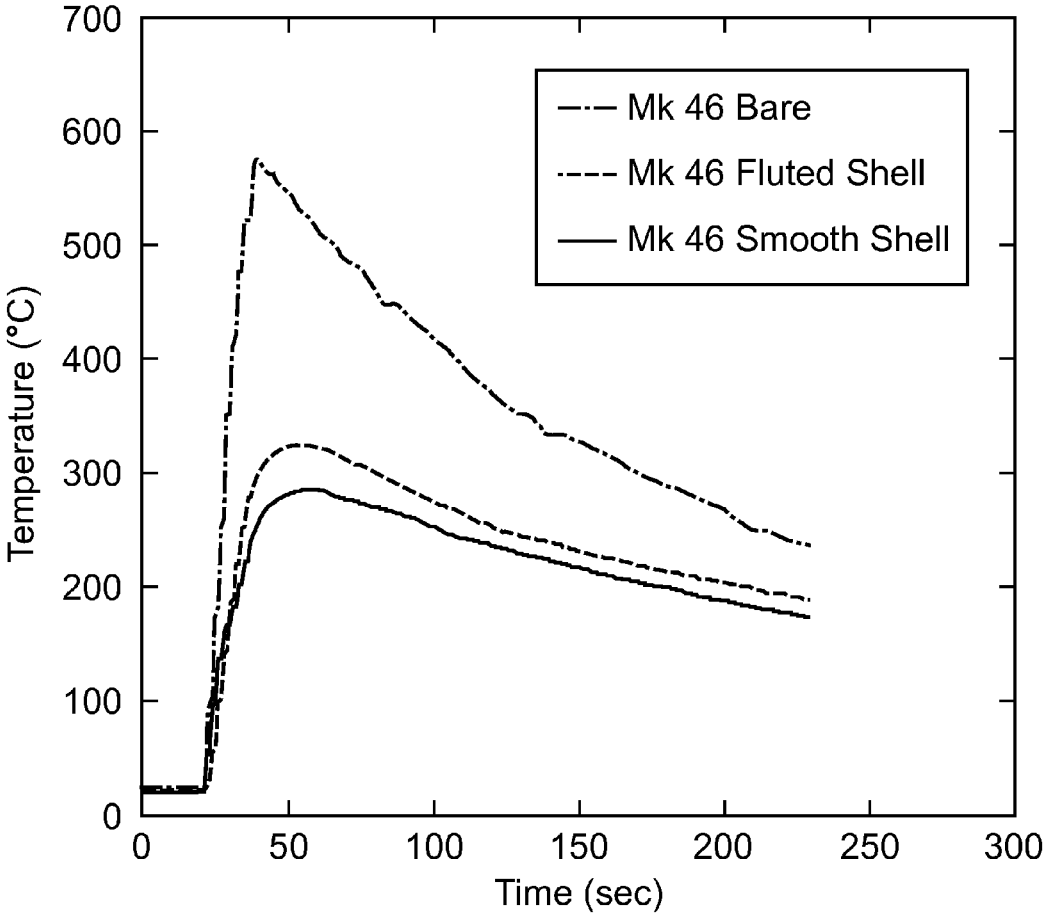
FIG. 6 is a plot comparing the temperature of a conventional Mk 46 barrel to the temperatures of Mk 46 barrels cooled with graphite foam shells over time.

Referring next to FIG. 6, the results of the Mk-46 live-fire tests confirm that the shells 14 cool the barrels 12 significantly over a conventional, bare barrel. It is thus possible to reduce the barrel 12 temperatures by nearly 50% during a continuous cyclic rate of fire. Please note that the smooth shell 14 outperformed the fluted shell 14 in this particular test. It is believed that the additional graphite foam volume of the smooth shell 14 contributed to the improved heat transfer and reduced temperatures. Under more adverse conditions (e.g., rain, snow or high wind); however, the fluted shell 14 may actually dissipate more heat through convection than the smooth shell 14 will.

Figure 7:
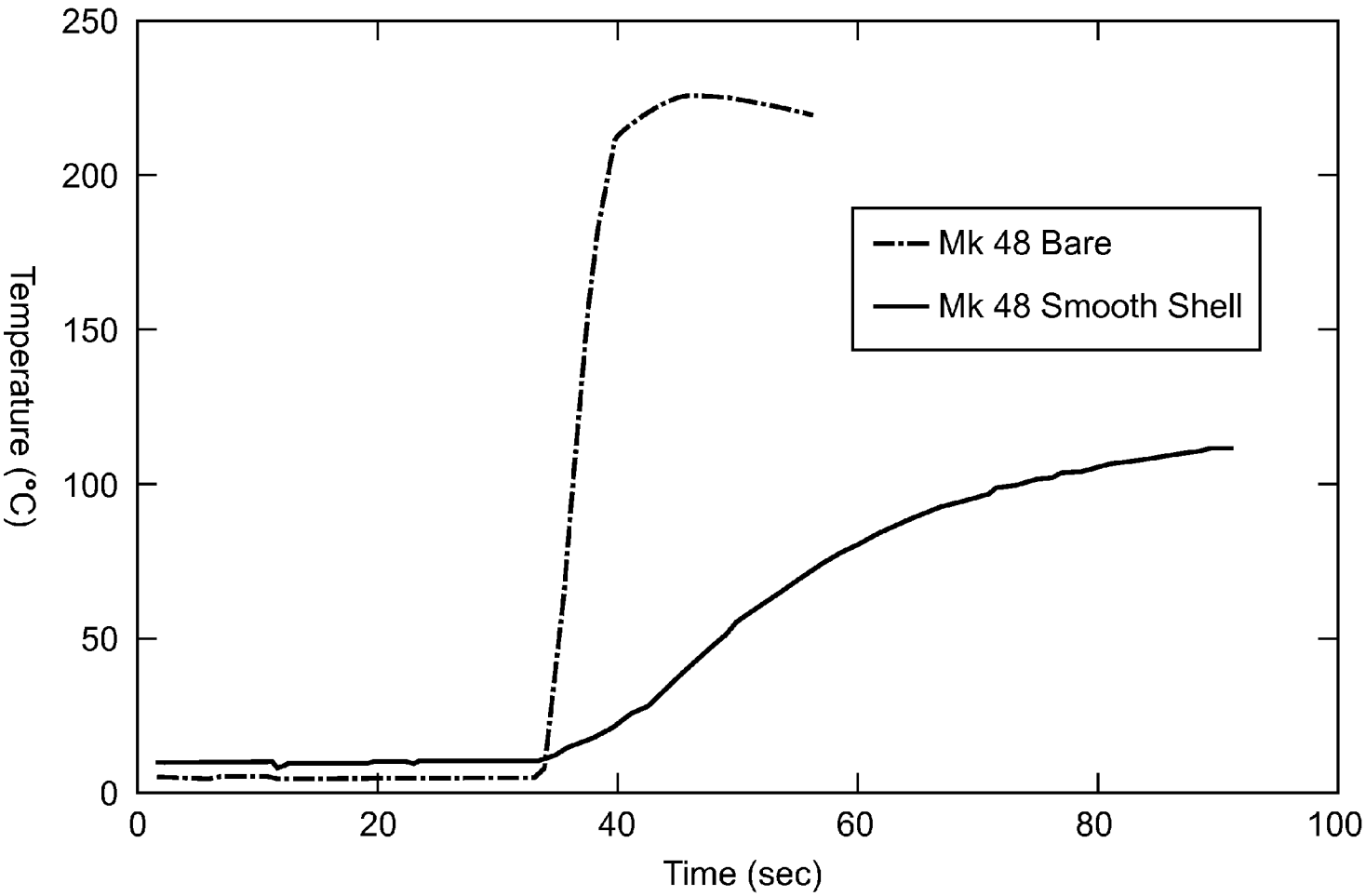
FIG. 7 is a plot comparing the temperature of a conventional Mk 48 barrel to the temperature of an Mk 48 barrel cooled with a graphite foam shell over time.

A second test was conducted with a 7.62 caliber weapon, the Mk-48 from FNH USA. A foam wrap was made from the Koppers L1-HD foam, densified with a phenolic resin to a 40% by weight loading and cured to 300° C. The wrap was bonded to the barrel of the Mk-48 with the Aremco 568 resin and cured at 100° C. for 2 hours. After cure, the weapon was tested with one belt of ammunition in the fully cyclic mode (one trigger pull dispenses the entire 100 round belt). The temperature of the surface of the barrel (measured between the foam and the barrel) was compared to that of the surface of a barrel that was not wrapped with foam (i.e. as received). As can be seen in FIG. 7, the temperature of the foam wrapped barrel was significantly reduced due to the foam wicking the heat from the barrel and transferring it to the air very quickly.

Figure 8:
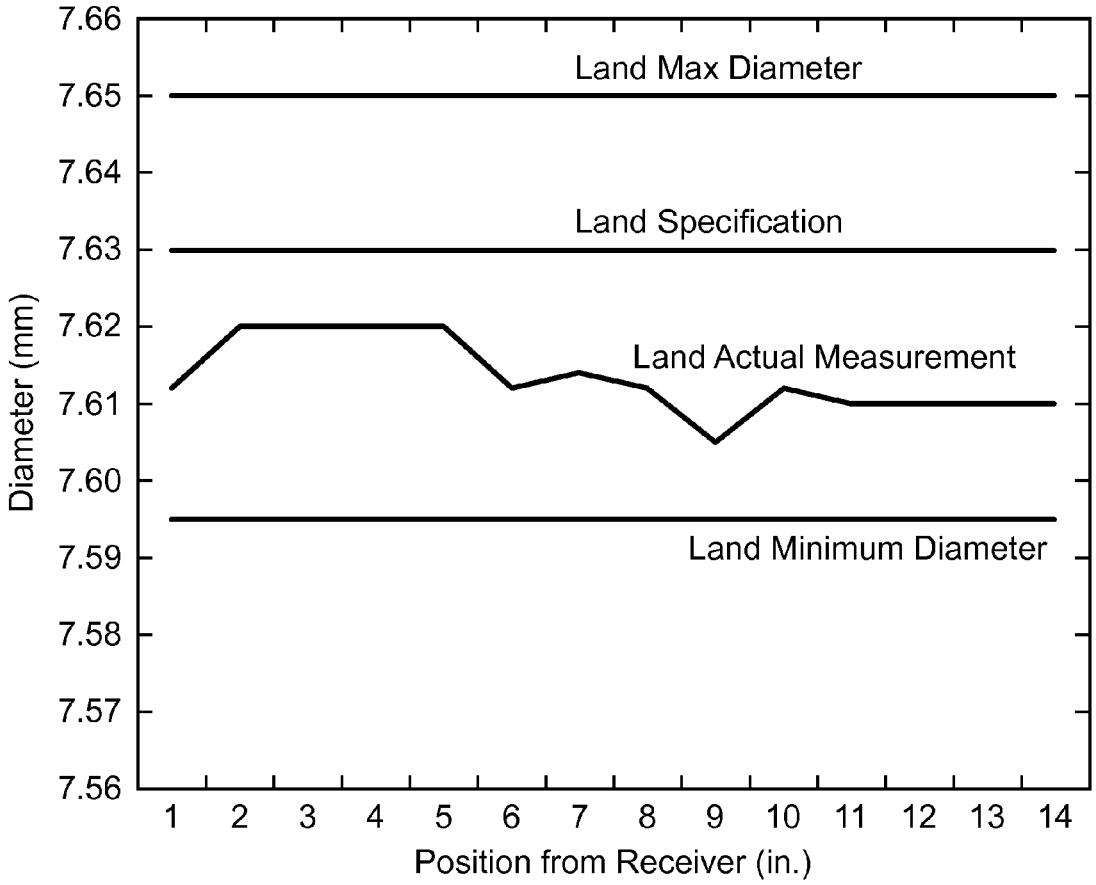
FIG. 8 is a plot comparing the barrel land specifications of a conventional Mk 48 barrel to the actual barrel land dimensions of a cooled Mk 48 barrel after firing 18,000 rounds.
Figure 9:
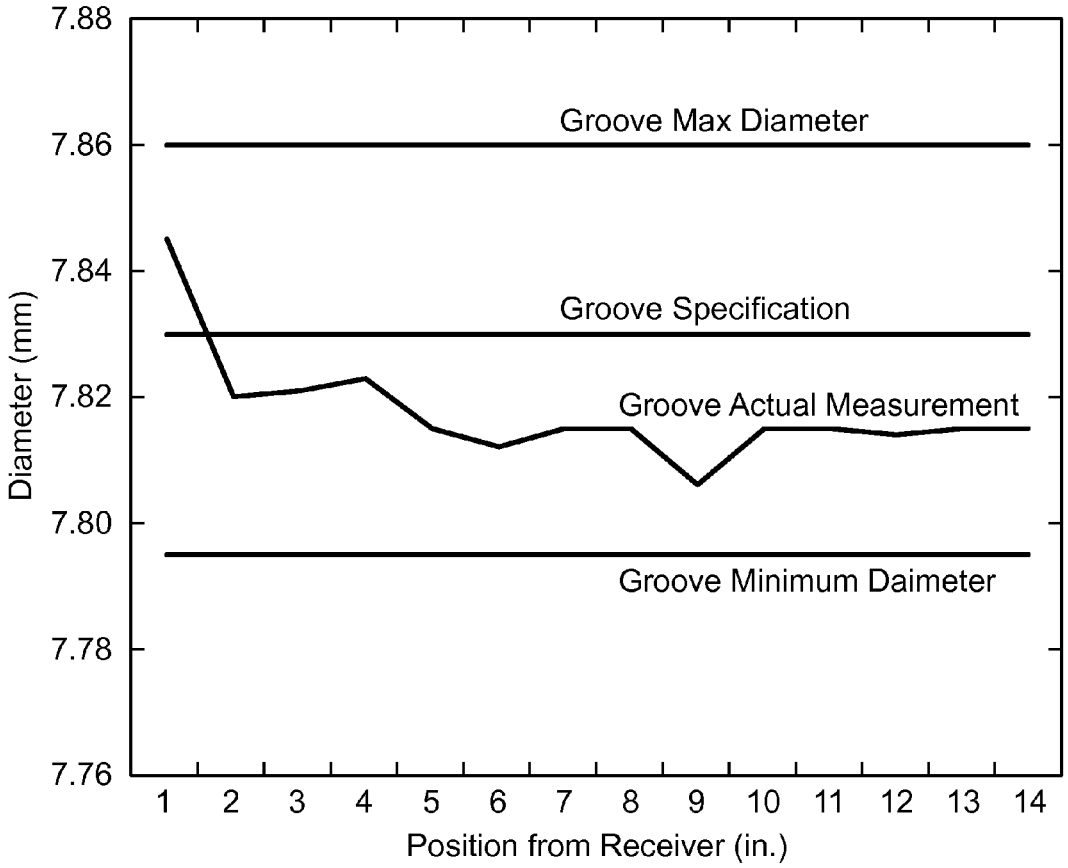
FIG. 9 is a plot comparing the barrel groove specifications of a conventional Mk 48 barrel to the actual barrel groove dimensions of a cooled Mk 48 barrel after firing 18,000 rounds.
Figure 10:
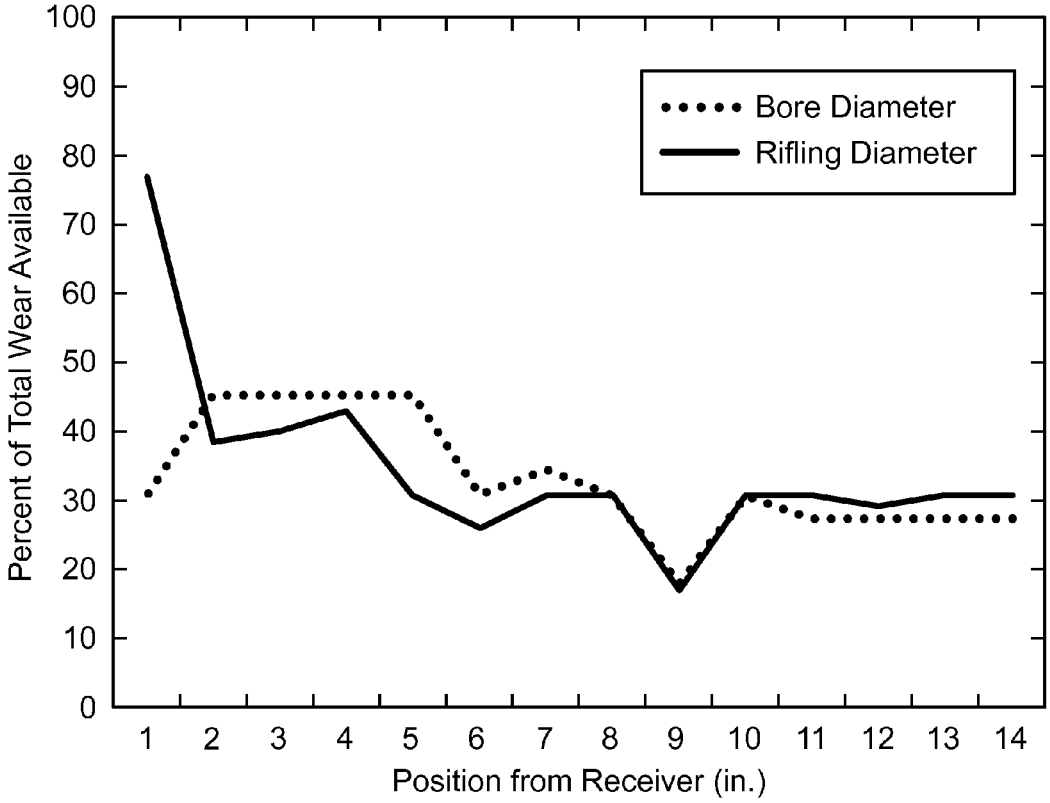
FIG. 10 is a plot comparing the percent of total wear available along the length of a cooled Mk 48 barrel after firing 18,000 rounds.

Next, the same Mk-48 weapon was endurance tested by an actual security force in a live-fire exercise. During this exercise, approximately 18,000 rounds were fired through the passively cooled barrel. Typically, a bare barrel will fail barrel gauge testing due to excessive wear after approximately 15,000 rounds. The endurance tested barrel was bore gauged at FNH USA in Columbia, S.C. and the results are shown in FIGS. 8-10. As can be seen, the reduced temperatures significantly reduced barrel wear, as the results of the wear test show that the barrel was not only within the maximum allowed, but still smaller diameter than the specification required prior to shipping to the customer from the factory (except at the throat of the barrel). This indicates that the barrel showed very little wear after the 18,000 rounds were fired in the exercise.

Barrel shells 14 made of graphite foam have been fabricated for the following weapons: Mk 48 (.308 cal or 7.62 NATO); Mk 46 (.223 cal or 5.56 NATO); M-249 (.233 cal or 5.56 NATO); M-240 (.308 cal or 7.62 NATO) and Ruger 10/22 (.22 cal). While this disclosure illustrates and enables many specific examples, they are not to be construed as exhaustive. Accordingly, the invention is intended to embrace those alternatives, modifications, equivalents, and variations as fall within the broad scope of the appended claims.

What is claimed is:

1. An apparatus for passively cooling a barrel of a firearm comprising:

a shell including a body defined by a breech end, a muzzle end, a single featureless external surface and a contact surface extending along an entire longitudinal length of said body that is proximate to, and in thermal communication with, an outer surface of the barrel, said body being formed entirely of graphite foam and extending at least partially around the outer surface of the barrel, and wherein said entire contact surface is in direct physical contact with the outer surface of the barrel, without any additional structural elements therebetween; and wherein heat from the barrel is wicked outwardly through said body to the single featureless external surface extending around said body and along a majority of the longitudinal length of said body where it radiates directly into the surrounding air to reduce the temperature of the barrel.

2. The apparatus as recited in claim 1 wherein said shell is a single, tubular-shaped structure that fits around the barrel.

3. The apparatus as recited in claim 1 wherein said shell is two or more separate segments.

4. The apparatus as recited in claim 1 wherein the graphite foam is produced with a production pressure of between about 250 pounds per square inch and about 1000 pounds per square inch.

5. The apparatus as recited in claim 4 wherein the graphite foam is produced with multi-walled carbon nanotubes added to a graphite foam precursor pitch in ratios of between about 0.2 percent by weight and about 1.0 percent by weight.

6. The apparatus as recited in claim 4 wherein the graphite foam is partially filled to fully filled with a phenolic resin.

7. A passively cooled barrel assembly for a firearm comprising:

a barrel having an outer surface;

a shell including a body defined by a breech end, a muzzle end, a single featureless external surface and a contact surface extending along an entire longitudinal length of said body that is proximate to, and in thermal communication with, the outer surface of said barrel, said body being formed entirely of graphite foam and extending at least partially around the outer surface of said barrel wherein said entire contact surface is in direct physical contact with the outer surface of the barrel, without any additional structural elements therebetween; and wherein heat from said barrel is wicked outwardly through said body to the single featureless external surface extending around said body and along a majority of the longitudinal length of said body where it radiates directly into the surrounding air to reduce the temperature of said barrel.

8. The assembly as recited in claim 7 wherein said shell is a single, tubular-shaped structure.

9. The assembly as recited in claim 7 wherein said shell is two or more separate segments.

10. The assembly as recited in claim 7 wherein the graphite foam shell is produced with a production pressure of between about 250 pounds per square inch and about 1000 pounds per square inch.

11. The assembly as recited in claim 10 wherein the graphite foam is produced with multi-walled carbon nanotubes added to a graphite foam precursor pitch in ratios of between about 0.2 percent by weight and about 1.0 percent by weight.

12. The assembly as recited in claim 10 wherein the graphite foam is partially filled to fully filled with a phenolic resin.

13. An apparatus for passively cooling a barrel of a firearm comprising:

a shell including a body defined by a breech end, a muzzle end, a single featureless external surface and a contact surface extending along an entire longitudinal length of said body that is proximate to, and in thermal communication with, an outer surface of the barrel, said body being formed entirely of graphite foam and extending at least partially around the outer surface of the barrel, and wherein said entire contact surface is in direct physical contact with the outer surface of the barrel, without any additional structural elements therebetween;

clamping means for securing the shell to the barrel; and wherein heat from the barrel is wicked outwardly through said body to the single featureless external surface extending around said body and along a majority of the longitudinal length of said body where it radiates directly into the surrounding air to reduce the temperature of the barrel.

* * * * *